US009340961B2

(12) United States Patent
Roeser

(10) Patent No.: US 9,340,961 B2
(45) Date of Patent: May 17, 2016

(54) FLUSHING SYSTEM FOR PRESSURIZED TOILET

(76) Inventor: John O. Roeser, Barrington, IL (US)

( * ) Notice: Subject to any disclaimer, the term of this patent is extended or adjusted under 35 U.S.C. 154(b) by 1748 days.

(21) Appl. No.: 12/508,744

(22) Filed: Jul. 24, 2009

(65) Prior Publication Data

US 2010/0186157 A1 Jul. 29, 2010

Related U.S. Application Data

(60) Provisional application No. 61/143,309, filed on Jan. 8, 2009.

(51) Int. Cl.

| | |
|---|---|
| ***E03D 1/24*** | (2006.01) |
| ***E03D 3/10*** | (2006.01) |
| ***E03D 1/30*** | (2006.01) |

(52) U.S. Cl.

CPC . *E03D 3/10* (2013.01); *E03D 1/306* (2013.01)

(58) Field of Classification Search

USPC ..... 4/354–356, 357, 359, 362, 379, 382, 4/378, 385

See application file for complete search history.

(56) References Cited

U.S. PATENT DOCUMENTS

| | | | | |
|---|---|---|---|---|
| 914,011 | A * | 3/1909 | Adams | 4/355 |
| 1,379,712 | A * | 5/1921 | Munkel | 4/356 |
| 2,629,878 | A * | 2/1953 | De Witt | 4/362 |
| 3,142,846 | A | 8/1964 | Lackenmaier et al. | |
| 3,605,125 | A | 9/1971 | Gibbs et al. | |
| 3,817,489 | A | 6/1974 | Caron et al. | |
| 4,233,698 | A | 11/1980 | Martin | |
| 5,046,201 | A | 9/1991 | Steinhardt et al. | |
| 5,179,739 | A * | 1/1993 | Mann | 4/378 |
| 5,794,279 | A | 8/1998 | Schwartz | |
| 5,848,441 | A | 12/1998 | Smith et al. | |

FOREIGN PATENT DOCUMENTS

| | | |
|---|---|---|
| BE | 697142 | 10/1967 |
| DE | 8613877 | 7/1986 |

OTHER PUBLICATIONS

PCT International Search Report and Written Opinion for PCT/US2009/062916, Jul. 23, 2010.

PCT International Searching Authority, Apr. 7, 2010.

Patent Cooperation Treaty, International Preliminary Report on Patentability, in Application No. PCT/US2009/062916, dated Jul. 12, 2011.

* cited by examiner

*Primary Examiner* — Lauren Crane
*Assistant Examiner* — Erin Deery
(74) *Attorney, Agent, or Firm* — McAndrews, Held & Malloy, Ltd.

(57) ABSTRACT

A toilet system including a bowl and a tank configured to hold water and air and deliver water to the bowl. The tank includes a water inlet and outlet. A valve having a seal pivots between an open position and a closed position where the seal closes the outlet. A lever positioned outside of the tank pivots to push the valve out of the closed position and towards the open position such that the outlet is opened and water flows out of the tank into the bowl. The valve rotates to the open position as water flows from the tank until the weight of the seal causes the valve to pivot back to the closed position. A plunger extends into the tank and applies a force that pushes the valve away from the closed position to the open position.

22 Claims, 4 Drawing Sheets

FLUSHING SYSTEM FOR PRESSURIZED TOILET

RELATED APPLICATIONS

This application is related to, and claims priority from, Provisional Application No. 61/143,309, filed Jan. 8, 2009, titled "Toilet Flushing Mechanism," the complete subject matter of which is incorporated herein by reference in its entirety.

FIELD OF EMBODIMENTS OF THE INVENTION

The present invention relates generally to a pressurized toilet, and, more particularly, to a flushing system for releasing water from a pressurized tank into a toilet bowl.

BACKGROUND

In recent times, government regulations and environmental concerns have led to requirements that toilets minimize the amount of water used per flush. As a result, there are now pressurized toilets that use water pressure to limit the amount of water used in a flush. The tank of a pressurized toilet is typically situated above the bowl and is filled from below with water that enters the tank through an inlet connected to a large, pressurized water pipe. Air is compressed within the tank as the tank is filled with water, and the water stops entering the tank once the air pressure and water pressure in the tank meets a desired balance. The tank also includes a large outlet pipe that leads to a release valve that is positioned to release water into the bowl of the toilet. When the tank is filled with water, the release valve blocks the flow of water from the tank into the toilet bowl. The release valve is connected to a handle or button that is typically mounted on the outside of the tank. Activating the handle or button causes the release valve to open. When the valve opens, the high pressure in the tank forces the water through the large outlet pipe and out the valve, allowing for highly pressurized water to flow from the tank and into the toilet bowl. The pressurized flow of water into the bowl cleans the bowl and drains out of the bowl through an outlet pipe at the bottom of the bowl. When the flushing action is complete, the release valve closes and water flows back into the tank through the inlet, and the cycle of pressurizing the water in the tank begins again.

In conventional unpressurized tanks, the tremendous force of the pressurized water entering and exiting the tank and the sudden closing of the valves can cause "water hammer," or a pressure surge or wave, within the plumbing system that results in a loud noise and possible damage to the pipes to which the toilet is connected. Also, the valves are complicated devices, involve many parts, and are typically not easy to access for repair. Also, the handle on an existing pressurized toilet is connected to the release valve by a complex mechanism that extends into the tank through a seal and uses the force applied to the handle to pull the release valve or seal open from within the tank, and against the forces of gravity and the water pressure in the tank. Thus, an operator needs to apply as much as 60 pounds of force to open the release valve unless the toilet includes a complicated pilot valve that uses a large piston to provide the force to open the release valve.

SUMMARY OF EMBODIMENTS OF THE INVENTION

Certain embodiments of the present invention include a pressurized flush toilet system. The system includes a bowl and a tank configured to hold water and air and to deliver water to the bowl. The tank includes an inlet that delivers water into the tank and an outlet that allows water to exit the tank. The system includes a valve having a seal and a container, and the valve is configured to pivot between an open position and a closed position. The seal closes the outlet of the tank when the valve is in the closed position. The system includes a lever positioned outside of the tank and configured to be pivoted to engage the seal from below and push the valve out of the closed position and towards the open position such that the outlet is opened and water flows out of the tank and into the bowl. The weight of the pivoting container holding water causes the valve to continue to rotate to the open position as the water flows out of the tank until the weight of the seal causes the valve to pivot back to the closed position closing off the outlet.

Certain embodiments of the present invention include a pressurized flush toilet system. The system includes a bowl and a tank configured to hold water and air and to deliver water to the bowl. The tank includes an inlet that delivers water into the tank and an outlet that allows water to exit the tank. The system includes a valve having a seal, and the valve is configured to pivot between an open position and a closed position. The seal closes the outlet of the tank when the valve is in the closed position. The system includes a lever positioned below the tank and configured to engage said seal and a plunger extending out of the tank that is configured to engage the lever. The plunger is movable with respect to the tank and receives pressure from the air and water in the tank such that the plunger applies force to the lever causing the lever to apply force to the seal. The lever is pivoted to push the valve out of the closed position and towards the open position such that the outlet is opened and water flows out of the tank into the bowl. The weight of the seal causes the valve to pivot back to the closed position closing off the outlet.

Certain embodiments of the present invention include a pressurized flush toilet system. The system includes a bowl and a tank configured to hold water and air and to deliver water to the bowl. The tank includes an inlet that delivers water into the tank and an outlet that allows water to exit the tank. The system includes a valve having a seal and a container. The valve is configured to pivot between an open position and a closed position. The seal closes the outlet of the tank when the valve is in the closed position. The system includes a base having a cavity that extends from the outlet to the bowl, and the base includes a lever positioned within the cavity and a plunger extending out of the tank and into the cavity that is configured to engage the lever. The plunger is movable with respect to the tank and receives pressure from the air and water in the tank such that the plunger applies force to the lever causing the lever to apply force to the seal. The system includes a handle connected to the lever such that force applied to the handle is applied to the lever to cause the lever to apply force to the seal and push the valve out of the closed position and towards the open position such that the outlet is opened and water flows out of the tank into the bowl. The weight of the container holding water causes the valve to continue to rotate to the open position as the water flows out of the tank until the water drains from the container and the weight of the seal causes the valve to pivot back to the closed position closing off the outlet.

The draining container also delays the closing of the seal such that water entering the tank through the inlet is able to flow through the empty tank and out of the open outlet into the toilet bowl to fill the bowl after the contents of the bowl are emptied.

Certain embodiments of the present invention include a pressurized flush toilet system. The system includes a bowl and a tank configured to hold water and air in a pressurized state and to deliver water to the bowl. The tank includes an inlet that delivers water into the tank and an outlet that allows water to exit the tank. The system includes a valve having a seal and being configured to pivot between an open position and a closed position, wherein the seal closes the outlet of the tank when the valve is in the closed position. The system includes a lever positioned outside of the tank and configured to be pivoted to engage the seal and push the valve into the tank and out of the closed position and towards the open position such that the outlet is opened and water flows out of the tank into the bowl. The valve is configured to pivot back to the closed position closing off the outlet.

Certain embodiments of the present invention include a pressurized flush toilet system. The system includes a bowl and a tank configured to hold water and air and to deliver water to the bowl. The tank includes an inlet that delivers water into the tank and an outlet that allows water to exit the tank. The system includes a valve having a seal and being configured to pivot between an open position and a closed position, wherein the seal closes the outlet of the tank when the valve is in the closed position. The system includes a lever positioned outside of the tank and configured to be pivoted to engage the seal and push the valve out of the closed position and towards the open position such that the outlet is opened and water flows out of the tank into the bowl. The lever includes a container that fills with water when the valve is moved from the closed position, and the weight of the container containing water causes the lever to engage the valve such that the valve rotates to the open position.

Certain embodiments of the present invention include a pressurized flush toilet system. The system includes a bowl and a tank configured to hold water and air and to deliver water to the bowl. The tank includes an inlet that delivers water into the tank and an outlet that allows water to exit the tank. The system includes a valve including a seal. The valve is configured to pivot between an open position and a closed position, wherein the seal closes the outlet of the tank when the valve is in the closed position. The system includes a lever positioned outside of the tank and configured to engage the seal and a plunger that extends out of the tank and is connected to the valve. The plunger is movable with respect to the tank and receives pressure from the air and water in the tank such that the plunger applies a force which adds to the force applied to the seal by the outside lever to cause the valve to pivot away from the closed position toward the open position. Force is applied to pivot the lever to push the valve out of the closed position and towards the open position such that the outlet is opened and water flows out of the tank into the bowl. The weight of the seal causes the valve to pivot back to the closed position closing off the outlet.

Figure 1:
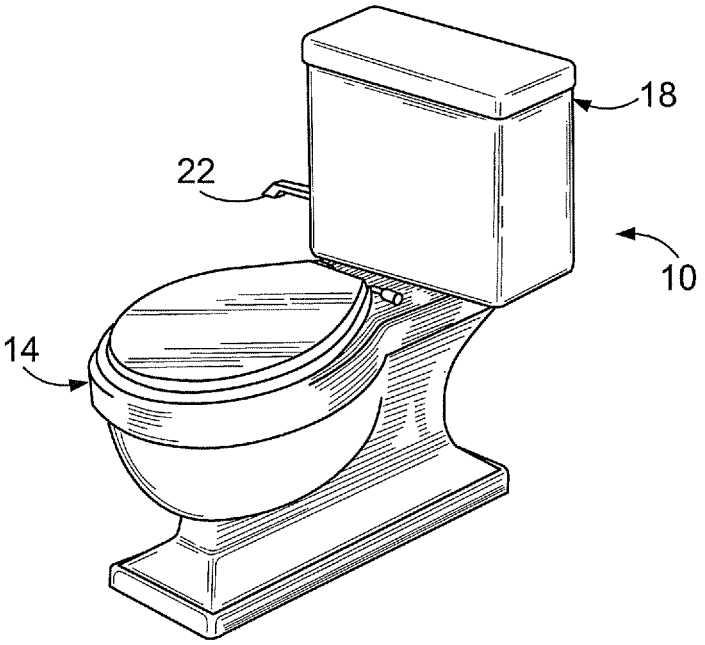
FIG. 1 illustrates a top isometric view of a toilet, according to an embodiment of the present invention.

Because the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

FIG. 1 illustrates an isometric view of a toilet 10 according to an embodiment of the present invention. The toilet 10 includes a bowl section 14 with a tank or dome 18 mounted thereto. The tank 18 includes a handle 22 positioned along a side thereof that is used to flush the toilet 10. The handle 22 can be positioned at other places on the tank 18 or toilet 10.

Figure 2:
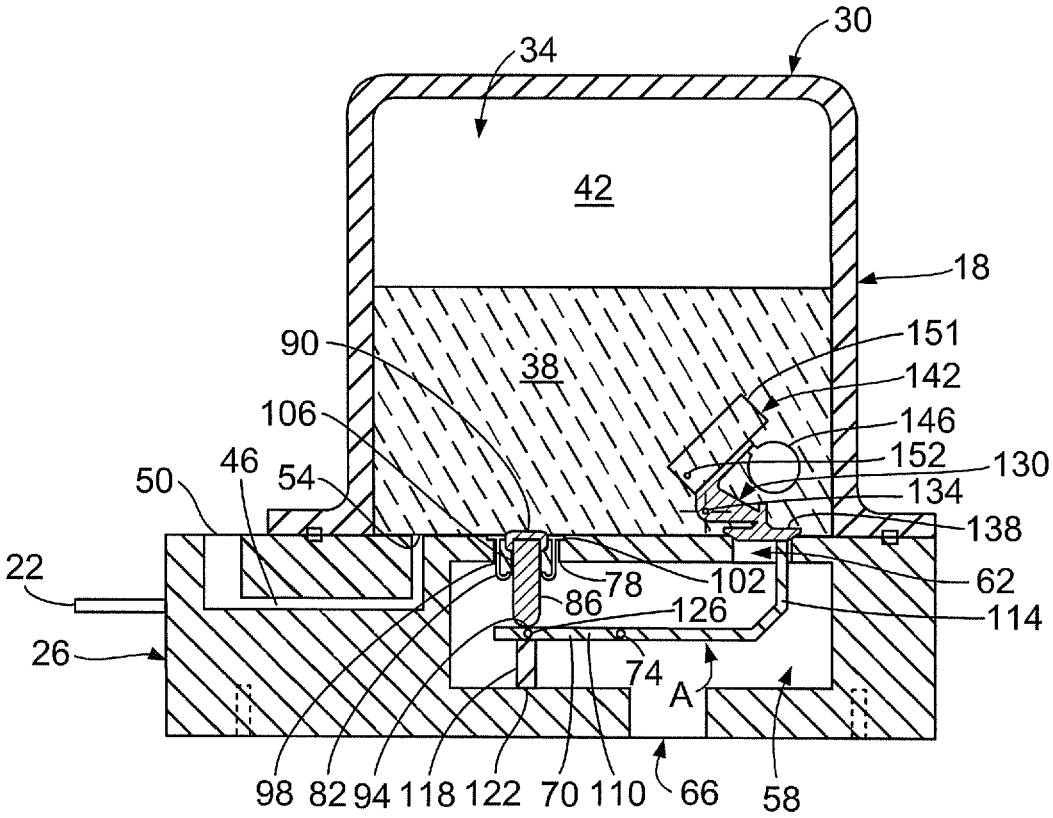
FIG. 2 illustrates a cutaway front view of the tank of FIG. 1, according to an embodiment of the present invention.

FIG. 2 illustrates a cutaway front view of the tank 18 of FIG. 1. The tank 18 includes a base 26 and a cover 30 that define a reservoir 34. The reservoir 34 holds water 38 and air 42. The tank 18 can have different shapes and sizes. By way of example only, the tank 18 can be generally cylindrical. By way of example only, the tank 18 is made of ceramic material. The air 42 is compressed by the water 38 such that the water is pressurized within the tank 18. The base 26 includes a water inlet 46 that has a first opening 50 that leads to an external water pipe (not shown) and a second opening 54 that leads into the reservoir 34 of the tank 18. The external pipe feeds water from the plumbing system of the building in which the toilet 10 is located into the water inlet 46. The inlet 46 does not include a valve and allows water to flow freely into the reservoir 34. The compressed air 42 within the reservoir 34 prevents any more water from entering the reservoir by way of the inlet 46 after a certain point. At this point, the reservoir 34 is at a pressurized equilibrium. By way of example only, the water 38 is pressurized at 30 to 50 pounds per square inch within the tank 18.

The base 26 also includes an interior cavity 58 that is connected to the reservoir 34 of the tank 18 by a first outlet 62 and is connected to the bowl 14 (FIG. 1) of the toilet 10 by a second outlet 66. The outlet 66 may be connected to the bowl 14 by an outlet pipe. The base 26 includes a plunger opening 78 positioned between the reservoir 34 of the tank 18 and the cavity 58 of the base 26. A cylindrical rolling boot 82 is positioned within the plunger opening 78 and receives a plunger 86. The plunger 86 is generally cylindrical and has a cylindrical head 90 at one end and a rounded tip 94 at another end. The rolling boot 82 has a concentric U-shape with an outer wall 98 having a seal 102 positioned about the plunger opening 78 and an inner wall 106 configured to resistably engage the head 90 of the plunger 86. The weight and pressure of the pressurized water 38 in the tank 18 on the head 90 of the plunger 86 keeps the head 90 pressed firmly against the inner wall 106 of the rolling boot 82.

A valve 130 is mounted in the reservoir 34 proximate the first outlet 62. The valve 130 is configured to rotate about a pivot 134. The valve 130 includes a circular sealing flap or seal 138 sized and shaped to cover and seal the first outlet 62. The seal 138 can be made of rubber or any other flexible, sealing material. The valve 130 also includes a container, or water clock, 142 and a flotation device 146. The container 142 has an open top 151 that receives water and includes a drain hole 152 opposite the open top 151. When the seal 138 is positioned to close and seal the first opening 62, the valve 130 is in a closed position. The pressure and weight of the water 38 in the reservoir 34 holds the seal 138 in the closed position. When the valve 130 is in the closed position, and the tank 18 is filled with water 38, the container 142 is full of water and is at a generally 40-50 degree angle with respect to the base 26. By way of example only, the container 142 is made of metal, ceramic, or plastic and holds around four ounces of water.

A lever 70 is mounted within the cavity 58 of the base 26 and rotates about a pivot 74. The lever 70 has a generally flat base section 110 formed with a arm 114 that is generally perpendicular to the base section 110. By way of example only, the lever 70 is made of steel or aluminum. The arm 114 extends into the first outlet 62. A spring 118 is mounted along, and extends upwardly from, a floor 122 of the cavity 58 and is positioned in a generally vertical alignment with the plunger 86. An engagement point 126 along the base section 110 of the lever 70 is positioned between the tip 94 of the plunger 86 and the spring 118. The engagement point 126 and the arm 114 of the lever 70 are on opposite sides of the pivot 74. The spring 118 resistably pushes upward against the engagement point 126 toward the tank 18, and the tip 94 of the plunger 86 resistably pushes downward against the engagement point 126 toward the floor 122 of the cavity 58 due to the pressure of the water 38 in the reservoir 34 pushing against the plunger head 90. The force applied by the plunger 86 is greater than the force applied by the spring 118, and this difference in force causes the arm 114 to push up against the seal 138 of the valve 130. The amount of force applied by the arm 114 to the seal 138 is not enough to push the seal 138 out of its closed position about the first outlet 62. By way of example only, when the seal 138 is in the closed position, a force of 60 pounds can be required to push the seal 138 upward and out of the closed position, but the force applied by the arm 114 of the lever 70 applies 50 pounds upward against the seal 138.

The external handle 22 is connected to the lever 70 by a handle lever 150 (FIG. 3) that extends through a passage (not shown) in the base 26. When a user rotates the handle 22, the handle lever 150 engages the lever 70 in order to apply force to rotate the lever 70 in the direction of Arrow A.

Figure 3:
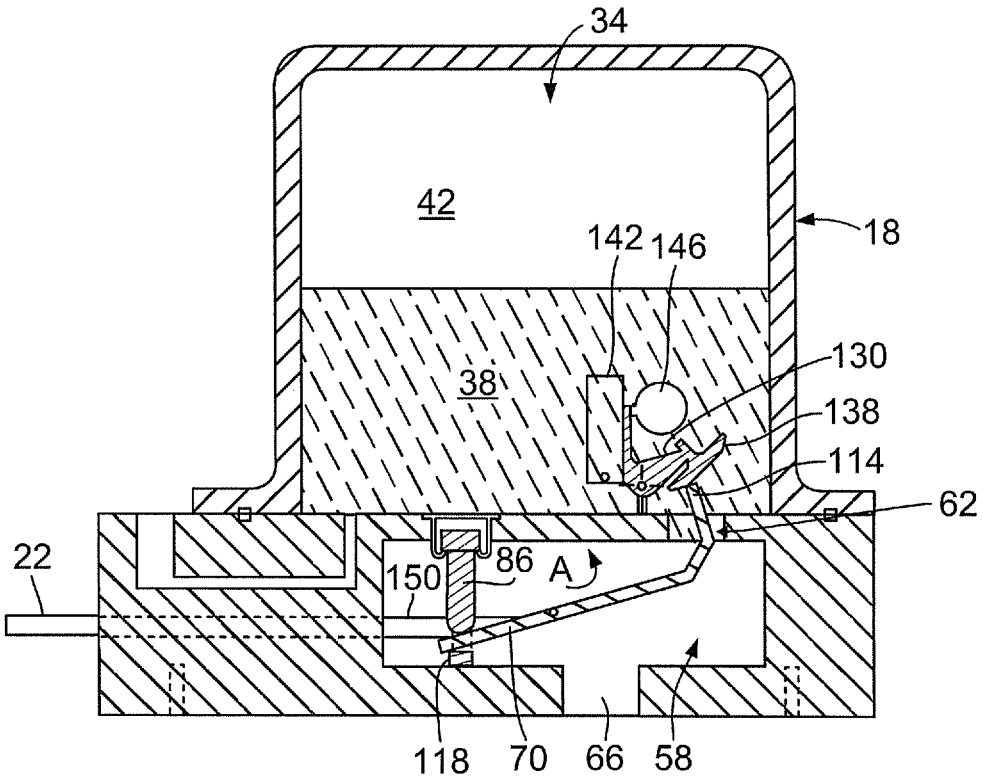
FIG. 3 illustrates a cutaway front view of the tank of FIG. 1, according to an embodiment of the present invention.

FIG. 3 illustrates a cutaway front view of the tank 18 of FIG. 1 that shows the water 38 being drained from the reservoir 34 into the bowl 14 (FIG. 1). Because a large portion of the force that is necessary to push the seal 138 upward and out of the first outlet 62 is already being supplied to the lever 70 by the plunger 86, a user operating the handle 22 applies the remainder of the force necessary to cause the lever 70 to rotate in the direction of Arrow A and push the seal 138 out of the closed position. By way of example only, the user may need to apply 10 pounds of force by rotating the handle 22 to cause the lever 70 to push the seal 138 upward and out of the first outlet 62. As the lever 70 is rotated in the direction of Arrow A to overcome the resistance of the closed valve 130 due to the force applied by a user turning the handle 22, the spring 118 is compressed and the plunger 86, which is pushed downward by the water 38 that is still in the tank 18 even after the valve 130 is opened, pushes further downward into the cavity 58. Once the seal 138 is partially moved out of the closed position, the clamping force of the seal 138 is greatly reduced such that the user can stop applying force by way of the handle 22 and the force applied to the lever 70 by the plunger 86 completes the process of opening the valve 130. To that end, the plunger 86 continues to apply force to the lever 70 such that the arm 114 of the lever 70 keeps pushing the seal 138 upward even after the user has stopped applying force to the lever 70 by way of the handle 22. In this way, the force applied by the pressurized plunger 86 to the lever 70 reduces and limits the amount of force that needs to be applied by a user turning the handle 22 and the amount of time that such force needs to be applied.

When the seal 138 is pushed out of the closed position about the first outlet 62 and is rotated in the direction of Arrow A past a certain point by the force of the arm 114 of the lever 70, the weight of the water in the container 142, combined with the flotation device 146 pulling the valve 130 in an upward direction, provides a counterbalance that pulls the valve 130 to an open position where the container 142 is generally vertical with respect to the floor 122 of the cavity 58 and holds the valve 130 in that position. By way of example, the valve 130 may rotate 40-50 degrees in the direction of Arrow A from the closed position to the open position. The water 38 continues to flow out of the reservoir 34 and through the outlet 62 when the valve 130 is moved to the open position As the valve 130 is moved to the open position, the pressurized water 38 in the reservoir 34 flows out of the first outlet 62 and into the cavity 58 and then out of the second outlet 66 and into the bowl 14 (FIG. 1) of the toilet 10. By way of example only, the water 38 can be pressurized at 30 psi upon being released from the tank 18. Because of the pressure on the water 38 in the reservoir 34 due to the compressed air 42, the water 38 empties out of the reservoir 34 and into the bowl 14 in a matter of seconds. The highly pressurized flow of water 38 from the tank 18 to the bowl 14 cleans the bowl 14 and then drains from the bowl 14 through a siphon pipe (not shown) in a few seconds while reducing the amount of water needed per flush. In an alternative embodiment, the tank 18 can be used to flush the bowl of a urinal. After the pressurized water has exited the bowl 14, water, which has flowed into the emptied tank 18 from the inlet 46, flows from the tank 18 through the outlets 62 and 66 into the bowl 14 to refill the bowl 14.

Figure 4:
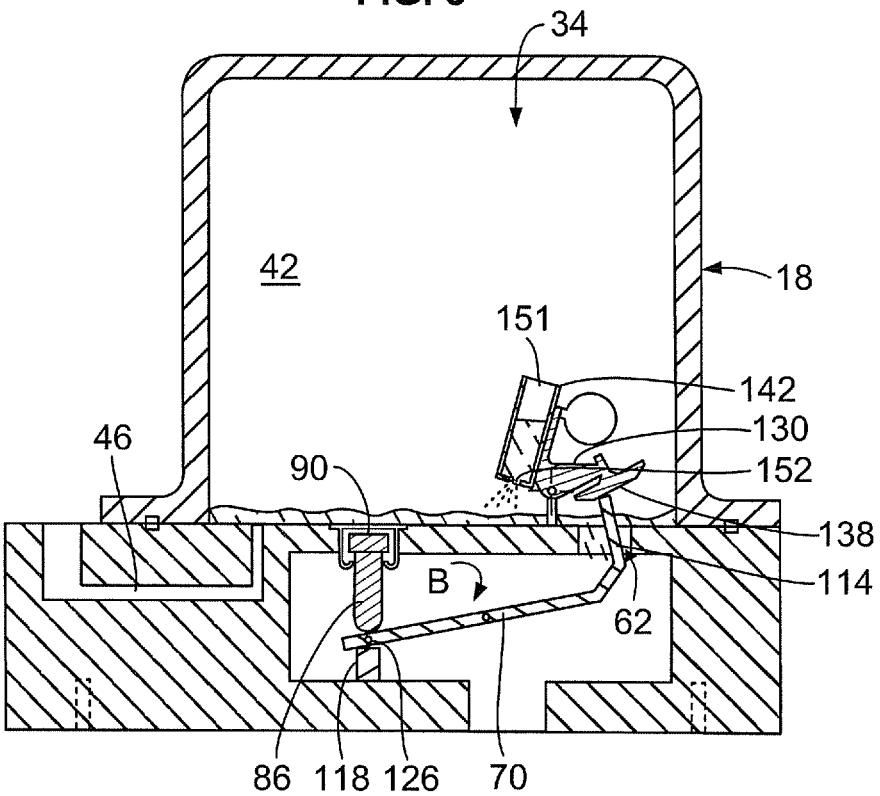
FIG. 4 illustrates a cutaway front view of the tank of FIG. 1, according to an embodiment of the present invention.

FIG. 4 illustrates a cutaway front view of the tank 18 of FIG. 1 that shows the water 38 drained from the reservoir 34. After most of the pressurized water has exited the reservoir 34, the valve 130 is still in the open position because water is still in the container 142 and the weight of that water holds the valve 130 in the open position. During this time, water continues to flow into the reservoir 34 by way of the inlet 46, and because the outlet 62 is still open, air can flow up into the reservoir 34 so that the cycle of pressurizing the tank 18 can begin again once the valve 130 is closed. In this way, the container 142 delays closure of the valve 130 such that water flowing into the reservoir 34 through the inlet 46 can drain out of the reservoir 34 to refill the bowl 14 with water after the pressurized water has been used to flush the bowl 14 and has exited the bowl 14 through the siphon pipe.

As the water drains from the container 142 through the drain hole 152, the weight of the container 142 is reduced to a point where the weight of the seal 138 is greater than the weight of the container 142 and the valve 130 rotates in the direction of Arrow B back toward the closed position. Because most of the water has drained from the reservoir 34, the plunger 86 applies very little force to the engagement point 126 of the lever 70. Therefore the spring 118 pushes the engagement point 126 upward such that that the lever 70 rotates in the direction of Arrow B. At the same time, the weight of the seal 138 pushes downward against the arm 114 of the lever 70. The weight of the seal 138 pushing against the arm 114 of the lever 70, combined with the force of the spring 118 pushing the engagement point 126 upward, allows for the seal 138 to move once again to the closed position over the first outlet 62. In this way, the container 142 controls the closing of the valve 130.

As new water continues to be delivered into the reservoir by way of the inlet 46 after the valve 130 is closed, the air 42 is compressed until the pressurization reaches a point that no more water can enter the reservoir 34. Thus, a point of water pressure equilibrium is again achieved in the reservoir 34. In this way, the reservoir 34 maintains generally the same amount of pressure for each flush without having to include a system to deliver air into the reservoir 34. Additionally, because there is air in the reservoir 34, a valve is not needed at the inlet 46 to dose water into the reservoir 34. Rather, the inlet 46 simply delivers water to the reservoir 34 until the compressed air 42 will not allow any more water to enter the reservoir 34. Alternatively, a pressure regulator may be provided at the water inlet 46 to limit pressure or backflow. The compressed air 42 serves as the mechanism to limit the amount of water that is delivered to the reservoir 34. Therefore, the inlet 46 can simply provide a constant flow of water without use of a valve, and as the reservoir 34 is emptied by flushing, the water can flow right back into the reservoir 34 by way of the inlet 46. The speed of water leaving the reservoir 34 due to the air pressure prevents the reservoir 34 from refilling so quickly that the container 142 does not have time to drain in a generally empty reservoir 34.

Once the reservoir 34 is re-filled with water, the container 142 of the valve 130 is re-filled as the water level rises above the top 151 of the container 142 and the plunger 86 is again pushed downward by the force of the water pushing against the plunger head 90. The lever 70 and the valve 130 are thus returned to their closed positions as shown in FIG. 2.

Figure 5:
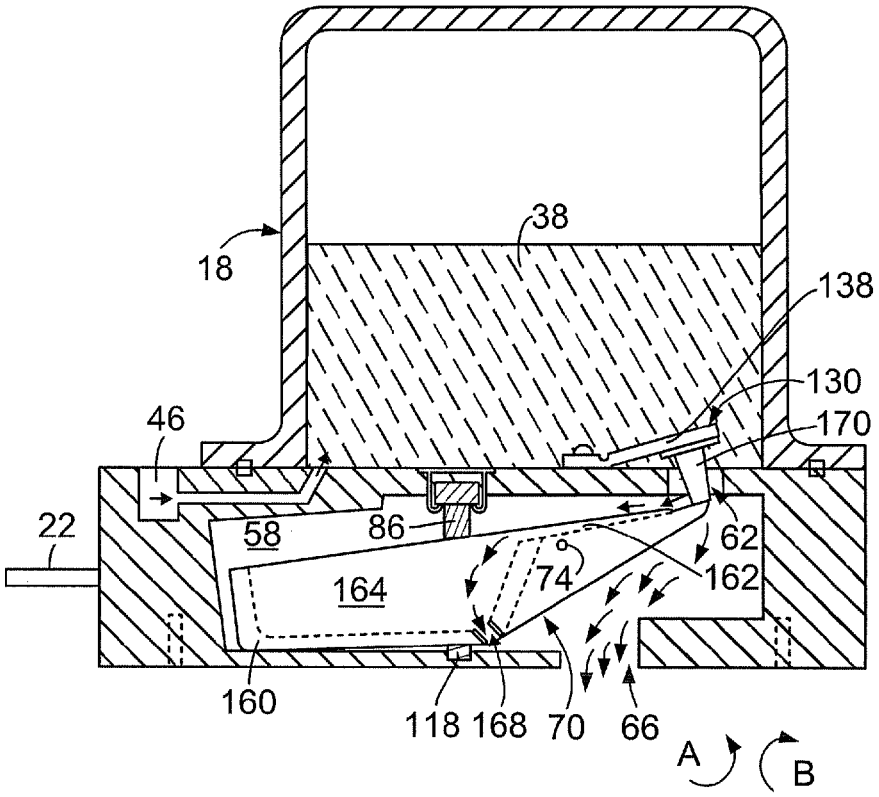
FIG. 5 illustrates a cutaway front view of a tank according to an embodiment of the present invention.

FIG. 5 illustrates a cutaway front view of the tank 18 according to an alternative embodiment. The lever 70 includes a container 160 connected to an arm 170. The container 160 is positioned between the plunger 86 and the spring 118. The container 160 includes a ledge 162 that leads to a reservoir 164. The container 160 includes a drain hole 168 that allows water to flow out of the container 160. The lever 70 is connected to the handle 22 and is configured to rotate about pivot 74. When the valve 130 is in the closed position, the reservoir 164 is not holding any water and a large portion of the force that is necessary to push the seal 138 upward and out of the first outlet 62 is already being supplied to the lever 70 by the plunger 86 due to the pressure applied to the plunger 86 by the water 38 in the tank 18. In operation, a user operating the handle 22 applies the remainder of the force necessary to cause the lever 70 to rotate in the direction of Arrow A and push the seal 138 out of the closed position. As the lever 70 is rotated in the direction of Arrow A to overcome the resistance of the closed valve 130 due to the force applied by a user turning the handle 22, the spring 118 is compressed and the plunger 86, which is still pushed downward by the water 38 that is still in the tank 18 even after the valve 130 is opened, pushes further downward into the cavity 58. Once the seal 138 is moved partially out of the closed position, the clamping force of the seal 138 is greatly reduced such that the user can stop applying force by way of the handle 22 and the force applied to the lever 70 by the plunger 86 completes the process of opening the valve 130. To that end, the plunger 86 continues to apply force to the lever 70 such that the arm 170 of the lever 70 keeps pushing the seal 138 upward even after the user has stopped applying force to the lever 70 by way of the handle 22.

As the valve 130 is moved toward the open position, the pressurized water 38 in the reservoir 34 flows out of the first outlet 62 and into the cavity 58. Most of the pressurized water flows out of the second outlet 66 and into the bowl 14 (FIG. 1) of the toilet 10, but some of the water flows along the ledge 162 of the lever 70 and into the reservoir 164. The weight of the water in the reservoir 164 causes the lever 70 to continue to rotate in the direction of Arrow A such that the arm 170 pushes the valve 130 to the open position. The lever 70 maintains the valve 130 in the open position while the weight of the water in the reservoir 164 is great enough to overcome the forces of the weight of the arm 170 and seal 138 and the upward force applied by the spring 118. As the water drains out of the reservoir 164 through the drain hole 168, the weight of the container 160 is reduced to a point where the weight of the seal 138, weight of the arm 170 and upward force of the spring 118 is greater than the weight of the container 160 and downward force of the plunger 86 and the valve 130 rotates in the direction of Arrow B, and causes the lever 70 to rotate in the in the direction of Arrow B, until the valve 130 is returned to the closed position. The water eventually drains completely from the reservoir 164 and the lever 70 is engaged by the plunger 86 and spring 118 such that the arm 170 engages and applies force to the valve 130 without applying enough force to push the valve 130 out of the closed position.

In this way, the containers 142 and 160 serve as timing mechanisms that control the closing of the valve 130. In the interval of time between the initial flow of most of the pressurized water from the tank 18 through the cavity 58 and into the bowl 14 and the closing of the valve 130, water continues to flow from the inlet 46 into the tank 18 and then out of the tank 18 through the cavity 58 and into the bowl 14 to refill the bowl 14 with water. Thus, the container 160 provides enough time after the initial pressurized flush of water from the tank 18 to the bowl 14 to allow for a less pressurized flow of water from the tank 18 to refill the bowl 14 after the flush.

Figure 6:
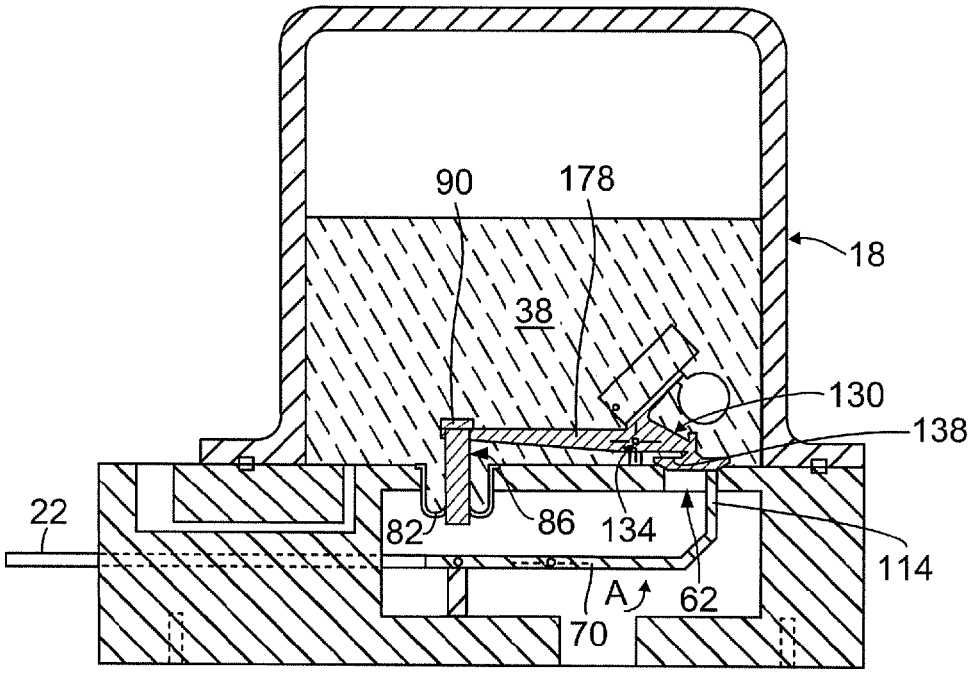
FIG. 6 illustrates a cutaway front view of a tank according to an embodiment of the present invention.

FIG. 6 illustrates a cutaway front view of the tank 18 according to an alternative embodiment. The plunger 86 is connected to the valve 130 by a linking member 178. The valve 130 as shown in FIG. 6 is in a closed position. When the valve 130 is in the closed position, the linking member 178 is positioned such that the plunger head 90 is suspended over the rolling boot 82. The weight of the water 38 in the tank 18 pushes down on the plunger head 90, and the weight of the water on the seal 138 of the valve 130 maintains the valve 130 in the closed position. Though the weight of the water pushing down on the plunger head 90 applies a force to pull the valve 130 to rotate about the pivot 134 in the direction of Arrow A away from the closed position, the amount of force applied to the plunger head 90 by the weight of the water is not enough to cause the valve 130 to rotate about the pivot 134 in the direction of Arrow A such that the seal 138 is moved out of its closed position about the first outlet 62. The lever 70 is connected to the handle 22, and the arm 114 extends into the first outlet 62 and is positioned to engage the valve 130.

Figure 7:
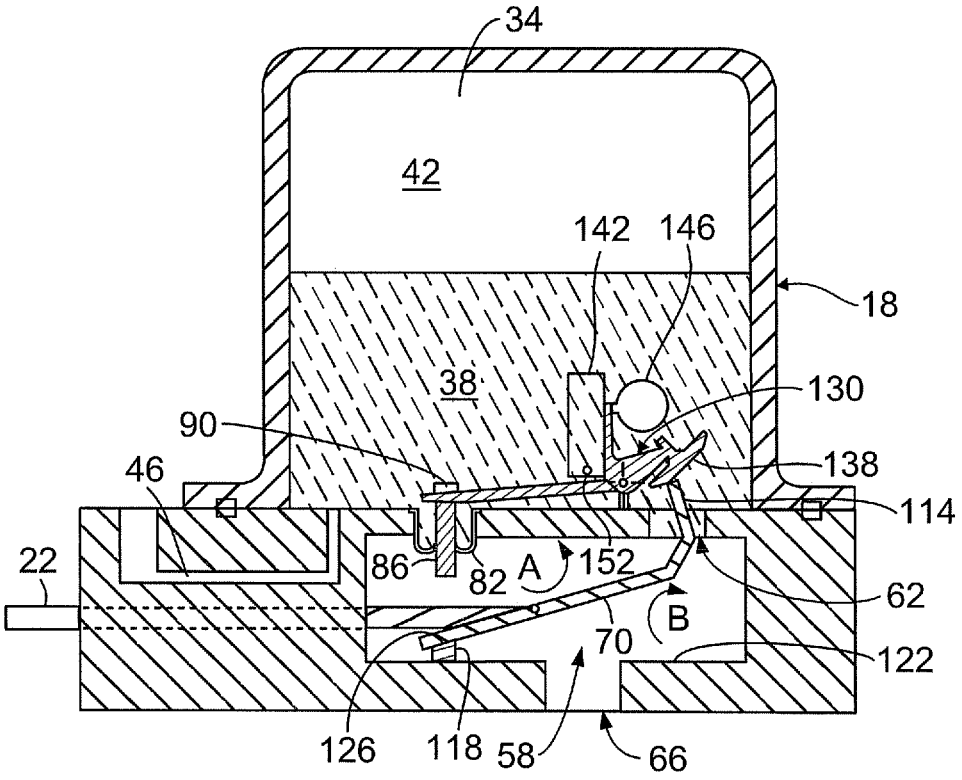
FIG. 7 illustrates a cutaway front view of a tank according to an embodiment of the present invention.

FIG. 7 illustrates a cutaway front view of the tank 18 of FIG. 6 that shows the water 38 being drained from the reservoir 34 into the bowl 14 (FIG. 1). Because a large portion of the force that is necessary to push the seal 138 upward and out of the first outlet 62 is already being applied by the plunger 86, a user operating the handle 22 applies the remainder of the force necessary to cause the lever 70 to rotate in the direction of Arrow A and push the seal 138 out of the closed position. By way of example only, the user may need to apply 10 pounds of force by rotating the handle 22 to cause the lever 70 to push the seal 138 upward and out of the first outlet 62. As the lever 70 is rotated in the direction of Arrow A to overcome the resistance of the closed valve 130 due to the force applied by a user turning the handle 22, the spring 118 positioned beneath the lever 70 is compressed and the plunger 86, which is pushed downward by the water 38 that is still in the tank 18 even after the valve 130 is opened, pushes further downward into the cavity 58 until the plunger head 90 engages the rolling boot 82. Once the seal 138 is partially moved out of the closed position, the clamping force of the seal 138 is greatly reduced such that the user can stop applying force by way of the handle 22 and the downward force applied by the plunger 86 causes the valve 130 to continue to rotate in the direction of Arrow A to an open position. To that end, the plunger 86 continues to apply force such that the seal 138 continues to rotate in the direction of Arrow A even after the user has stopped applying force to the lever 70 by way of the handle 22. In this way, the downward force applied to the plunger 86 causes the valve 130 to rotate out of the closed position and thus reduces and limits the amount of force that needs to be applied by a user turning the handle 22 and the amount of time that such force needs to be applied.

When the seal 138 is pushed out of the closed position about the first outlet 62 and is rotated in the direction of Arrow A past a certain point by the upward force of the arm 114 of the lever 70 and the rotational pull of the plunger 86, the weight of the water in the container 142, combined with the flotation device 146 pulling the valve 130 in an upward direction, provides a counterbalance that pulls the valve 130 to an open position where the container 142 is generally vertical with respect to the floor 122 of the cavity 58 and holds the valve 130 in that position. By way of example, the valve 130 may rotate 40-50 degrees in the direction of Arrow A from the closed position to the open position. The water 38 continues to flow out of the reservoir 34 and through the outlet 62 when the valve 130 is moved to the open position As the valve 130 is moved to the open position, the pressurized water 38 in the reservoir 34 flows out of the first outlet 62 and into the cavity 58 and then out of the second outlet 66 and into the bowl 14 (FIG. 1) of the toilet 10. After the pressurized water has exited the bowl 14, water, which has flowed into the emptied tank 18 from the inlet 46, flows from the tank 18 through the outlets 62 and 66 into the bowl 14 to refill the bowl 14.

After most of the pressurized water has exited the reservoir 34, the valve 130 is still in the open position because water is still in the container 142 and the weight of that water holds the valve 130 in the open position. During this time, water continues to flow into the reservoir 34 by way of the inlet 46, and because the outlet 62 is still open, air can flow up into the reservoir 34 so that the cycle of pressurizing the tank 18 can begin again once the valve 130 is closed.

As the water drains from the container 142 through the drain hole 152, the weight of the container 142 is reduced to a point where the weight of the seal 138 is greater than the weight of the container 142 and the valve 130 rotates in the direction of Arrow B back toward the closed position. Because most of the water has drained from the reservoir 34, the plunger 86 applies very little force to cause the valve 130 to rotate in the direction of Arrow A. The weight of the seal 138 pushing against the arm 114 of the lever 70, combined with the force of the spring 118 pushing the engagement point 126 of the lever 70 upward, allows for the seal 138 to move once again to the closed position over the first outlet 62. As the valve 130 moves back to the closed position the plunger 86 is lifted upward away from the rolling boot 82 such that the head 90 is again suspended over the rolling boot 82 in the tank 18.

As new water continues to be delivered into the reservoir by way of the inlet 46 after the valve 130 is closed, the air 42 is compressed until the pressurization reaches a point that no more water can enter the reservoir 34. Once the reservoir 34 is re-filled with water, the container 142 of the valve 130 is re-filled as the water level rises above the top 151 of the container 142 and the plunger 86 is again pushed downward by the force of the water pushing against the plunger head 90. The lever 70 and the valve 130 are thus returned to their closed positions as shown in FIG. 6.

Thus, embodiments of the present invention provide a high pressure toilet tank and flushing system that does not require the use of an inlet valve to the tank. In this way, the system limits the number of complicated parts needed to fill the tank, reduces the need for a large pipe to deliver water to the tank, and reduces the effect of water hammer from an inlet valve suddenly closing. Also, the tank outlet valve is kept in the sealed position by the weight and pressure of the water in the tank, and the water clock controls the closing of the valve to allow time to refill the bowl 14. Furthermore, the flushing system uses a plunger and lever to assist in pushing the outlet valve open from below and outside of the tank, and, as such, reduces the amount of force needed to open the outlet valve of the pressurized tank and allows for easy access to repair or replace the activating lever. Furthermore, by trapping air in the tank after each flush, the tank does not require a separate inlet to deliver a controlled amount of air into the tank to pressurize the water.

While various spatial and directional terms, such as top, bottom, lower, mid, lateral, horizontal, vertical, front and the like may be used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A pressurized flush toilet system, comprising:

a bowl;

a tank configured to hold water and air and to deliver water to said bowl, said tank including an inlet that delivers water into said tank and an outlet that allows water to exit said tank, a valve including a seal, said valve being configured to pivot between an open position and a closed position, wherein said seal closes said outlet of said tank when said valve is in said closed position;

a lever positioned outside of said tank and configured to engage said seal; and a plunger extending out of said tank that is configured to engage said lever, said plunger being movable with respect to said tank and receiving pressure from the air and water in said tank such that said plunger applies force to said lever causing said lever to engage and apply force to said seal, wherein force is applied to pivot said lever to push said valve out of said closed position and towards said open position such that said outlet is opened and water flows out of said tank into said bowl and the weight of said seal causes said valve to pivot back to said closed position closing off said outlet.

2. The pressurized flush toilet system of claim 1, wherein said valve includes a container connected to said seal and the weight of said container containing water causes said valve to continue to rotate to said open position when said lever pushes said valve out of said closed position.

3. The pressurized flush toilet system of claim 2, wherein, as the water flows out of said tank and said valve is in said open position, water drains from a hole in said container to a point where the weight of said seal is greater than the weight of said container and causes said valve to pivot back to said closed position closing off said outlet.

4. The pressurized flush toilet system of claim 1, wherein said lever includes a container that fills with water when said valve is moved from said closed position, and the weight of said container containing water causes said lever to engage said valve such that said valve rotates to said open position.

5. The pressurized flush toilet system of claim 4, wherein water drains from a hole in said container to a point where the weight of said valve pushes said lever such that said valve rotates back to said closed position closing off said outlet.

6. The pressurized flush toilet system of claim 1, further comprising a handle external to said tank, said handle being connected to said lever such that force applied to said handle is applied to said lever to cause said lever to apply force to said seal and push said valve out of said closed position.

7. The pressurized flush toilet system of claim 1, wherein said inlet delivers water into said tank until the pressure of air and water in said tank prevents any more water from entering said tank.

8. The pressurized flush toilet system of claim 1, further comprising a spring configured to resistably engage said lever and positioned opposite said plunger such that said spring and said plunger apply opposing forces to said lever.

9. The pressurized flush toilet system of claim 1, wherein said valve includes a flotation device that pulls said valve from said closed position toward said open position when said lever pushes said valve out of said closed position.

10. The pressurized flush toilet system of claim 1, further including a base having a cavity that extends from said outlet to said bowl, said lever being positioned within said cavity and said cavity including another outlet that extends from said cavity to said bowl.

11. A pressurized flush toilet system, comprising:

a bowl;

a tank configured to hold water and air and to deliver water to said bowl, said tank including an inlet that delivers water into said tank and an outlet that allows water to exit said tank, a valve including a seal and a container connected to said seal, said valve being configured to pivot between an open position and a closed position, wherein said seal closes said outlet of said tank when said valve is in said closed position;

a base having a cavity that extends from said outlet to said bowl, said base including a lever being positioned within said cavity and a plunger extending out of said tank and into said cavity that is configured to engage said lever, said plunger being movable with respect to said tank and receiving pressure from the air and water in said tank such that said plunger applies force to said lever causing said lever to apply force to said seal; and a handle connected to said lever such that force applied to said handle is applied to said lever to cause said lever to apply force to said seal and push said valve out of said closed position and towards said open position such that said outlet is opened and water flows out of said tank into said bowl, wherein the weight of said container holding water causes said valve to continue to rotate to said open position as the water flows out of said tank until the water drains from said container and the weight of said seal causes said valve to pivot back to said closed position closing off said outlet.

12. The pressurized flush toilet system of claim 11, wherein said inlet delivers water into said tank until the pressure of air and water in said tank prevents any more water from entering said tank.

13. The pressurized flush toilet system of claim 11, further comprising a spring configured to resistably engage said lever and positioned opposite said plunger such that said spring and said plunger apply opposing forces to said lever.

14. The pressurized flush toilet system of claim 11, wherein said valve includes a flotation device that pulls said valve from said closed position toward said open position when said lever pushes said valve out of said closed position.

15. A pressurized flush toilet system, comprising:

a bowl;

a tank having a base and a reservoir, wherein said reservoir is configured to hold water and air in a pressurized state and to deliver water to said bowl, said tank including an inlet that delivers water into said reservoir and an outlet that allows water to exit said reservoir, a valve including a seal, said valve being configured to pivot between an open position and a closed position, wherein said seal closes said outlet of said tank when said valve is in said closed position; and a lever positioned in a cavity in said base of said tank and configured to be pivoted to engage said seal and push said valve into said reservoir and out of said closed position and towards said open position such that said outlet is opened and water flows out of said reservoir into said bowl, wherein said valve is configured to pivot back to said closed position closing off said outlet.

16. The pressurized flush toilet system of claim 15, wherein said valve is configured to delay returning to said closed position for a period of time such that water continues to flow from said tank into said bowl to refill said bowl after said pressurized water flows out of said tank into said bowl and then out of said bowl.

17. The pressurized flush toilet system of claim 15, further comprising a plunger that extends out of said tank and is configured to engage said lever, said plunger being movable with respect to said tank and receiving pressure from the air and water in said tank such that said plunger applies force to said lever causing said lever to apply force to said seal.

18. The pressurized flush toilet system of claim 15, further comprising a plunger that is connected to said valve, said plunger being movable with respect to said tank and receiving pressure from the air and water in said tank such that said plunger applies a force to cause said valve to pivot away from said closed position toward said open position.

19. The pressurized flush toilet system of claim 15, wherein said valve includes a container connected to said seal and the weight of said container containing water causes said valve to continue to rotate to said open position when said lever pushes said valve out of said closed position.

20. The pressurized flush toilet system of claim 19, wherein, as the water flows out of said tank and said valve is in said open position, water drains from a hole in said container to a point where the weight of said seal is greater than the weight of said container and causes said valve to pivot back to said closed position closing off said outlet.

21. The pressurized flush toilet system of claim 15, wherein said lever includes a container that fills with water when said valve is moved from said closed position and the weight of said container containing water causes said lever to engage said valve such that said valve rotates to said open position.

22. The pressurized flush toilet system of claim 21, wherein water drains from a hole in said container to a point where the weight of said valve pushes said lever such that said valve rotates back to said closed position closing off said outlet.

* * * * *